US006994448B1

(12) United States Patent
Gorrell

(10) Patent No.: US 6,994,448 B1
(45) Date of Patent: Feb. 7, 2006

(54) SOLAR POWERED ILLUMINATED DEVICES

(76) Inventor: John H. Gorrell, P.O. Box 220, Pleasant Lake, IN (US) 46779

( * ) Notice: Subject to any disclaimer, the term of this patent is extended or adjusted under 35 U.S.C. 154(b) by 0 days.

(21) Appl. No.: 10/640,455

(22) Filed: Aug. 13, 2003

Related U.S. Application Data

(60) Provisional application No. 60/403,829, filed on Aug. 15, 2002.

(51) Int. Cl.
*F21L 13/00* (2006.01)
*F21L 4/00* (2006.01)

(52) U.S. Cl. ..... 362/183; 362/20; 362/184; 362/276; 40/573; 40/574

(58) Field of Classification Search ..... 362/20, 362/183–184, 276, 802, 29, 97, 812; 40/564, 40/573–574
See application file for complete search history.

(56) References Cited

U.S. PATENT DOCUMENTS 2,899,542 A * 8/1959 De Mauro ..... 362/364
3,189,744 A * 6/1965 Ogland ..... 398/130
3,235,989 A * 2/1966 Brooks ..... 40/549
3,300,885 A * 1/1967 Haire ..... 40/572
3,391,481 A * 7/1968 Lloyd ..... 40/549
3,431,003 A * 3/1969 Kilpatrick et al. ..... 292/256
3,678,458 A * 7/1972 Ljungkull et al. ..... 40/453
3,680,237 A * 8/1972 Finnerty, Sr. ..... 40/544
3,757,511 A * 9/1973 Burgess et al. ..... 368/83
3,982,824 A * 9/1976 Rambauske ..... 359/859
4,384,317 A * 5/1983 Stackpole ..... 362/183
4,486,820 A * 12/1984 Baba et al. ..... 362/183
4,611,265 A * 9/1986 Davis ..... 362/145
4,718,185 A * 1/1988 Conlin et al. ..... 40/442
4,844,582 A * 7/1989 Giannini ..... 385/57
4,851,968 A * 7/1989 Nino ..... 362/539
4,903,172 A * 2/1990 Schoniger et al. ..... 362/31
4,947,300 A * 8/1990 Wen ..... 362/183
4,949,487 A * 8/1990 Kibarer ..... 40/551
4,952,023 A * 8/1990 Bradshaw et al. ..... 359/529
4,989,124 A * 1/1991 Shappell ..... 362/183
5,005,108 A * 4/1991 Pristash et al. ..... 362/31

(Continued)

FOREIGN PATENT DOCUMENTS

CA 2287629 A1 * 4/2001

(Continued)

*Primary Examiner*—Stephen Husar
*Assistant Examiner*—Jason Han
(74) *Attorney, Agent, or Firm*—Krieg DeVault Lundy LLP

(57) ABSTRACT

A solar powered illuminated device is provided with a power module electrically connected to an illuminated module, the power module having a solar cell array electrically connected to a battery array having at least one rechargeable battery, the battery array being electrically connected to the illuminated module. The power module utilizes a power charging mode during generally daylight hours to charge the battery array with energy generated and provided by the solar cell array, and a photo switching device to switch from the power charging mode to a power source mode during generally non-daylight hours to enable the battery array to discharge current to the illuminated module to light up one or more housings in the illuminated module with a light source mounted in each housing. A display plate manufactured of one or more or a combination of opaque, translucent and transparent materials is positioned adjacent or proximate to a non-reflective side of each housing to display any of alphanumeric characters, symbols and/or designs utilizing the device without illumination during the daylight hours and with illumination during non-daylight hours.

71 Claims, 10 Drawing Sheets

U.S. PATENT DOCUMENTS 5,007,190 A * 4/1991 Shyu ..... 40/564
5,027,258 A * 6/1991 Schoniger et al. ..... 362/31
5,041,952 A * 8/1991 Janda et al. ..... 362/183
5,192,944 A * 3/1993 Otsuki et al. ..... 345/33
5,329,716 A * 7/1994 Fite ..... 40/575
5,435,087 A * 7/1995 Karkar et al. ..... 40/575
5,542,203 A * 8/1996 Luoma et al. ..... 40/610
5,567,042 A * 10/1996 Farchmin et al. ..... 362/241
5,573,328 A * 11/1996 Hwang ..... 362/554
5,729,924 A * 3/1998 Reading ..... 40/564
6,031,468 A * 2/2000 Tsao et al. ..... 340/908
6,034,319 A * 3/2000 Falbel ..... 136/246
6,042,243 A * 3/2000 Grill et al. ..... 362/125
6,059,582 A * 5/2000 Tsai ..... 439/121
6,101,750 A * 8/2000 Blesener et al. ..... 40/448
6,131,321 A * 10/2000 Daigle, Jr. ..... 40/612
6,150,996 A * 11/2000 Nicholson et al. ..... 345/1.3
6,185,356 B1 * 2/2001 Parker et al. ..... 385/133
6,299,325 B1 * 10/2001 Cathel ..... 362/183
6,314,669 B1 * 11/2001 Tucker ..... 40/448
6,339,188 B1 * 1/2002 Voelkner ..... 136/251
6,402,338 B1 * 6/2002 Mitzel et al. ..... 362/154
6,517,217 B1 * 2/2003 Liao ..... 362/235
6,543,911 B1 * 4/2003 Rizkin et al. ..... 362/307
6,741,222 B1 * 5/2004 Tucker ..... 345/1.1
6,745,507 B2 * 6/2004 Golding ..... 40/564
6,750,829 B2 * 6/2004 Luoma et al. ..... 345/1.1
6,817,123 B2 * 11/2004 Okazaki et al. ..... 40/452
2003/0063474 A1 * 4/2003 Coushaine ..... 362/517
2003/0121541 A1 * 7/2003 Hilton et al. ..... 136/244
2004/0022058 A1 * 2/2004 Birrell ..... 362/249
2004/0076013 A1 * 4/2004 Tseng ..... 362/431

FOREIGN PATENT DOCUMENTS

DE 3715943 A1 * 12/1988
FR 2081485 A * 2/1982

* cited by examiner

SOLAR POWERED ILLUMINATED DEVICES

This application claims priority based on U.S. Provisional Patent Application Ser. No. 60/403,829, entitled "Solar Powered Illuminated Devices," filed on Aug. 15, 2002, which is hereby incorporated herein by reference.

DETAILED DESCRIPTION OF EMBODIMENTS OF THE INVENTION

The invention in the various embodiments thereof described and claimed herein, and all equivalents thereof which will be evident to those skilled in the relevant art, relates generally to illuminated devices, and more particularly to solar powered illuminated displays.

Figure 1:
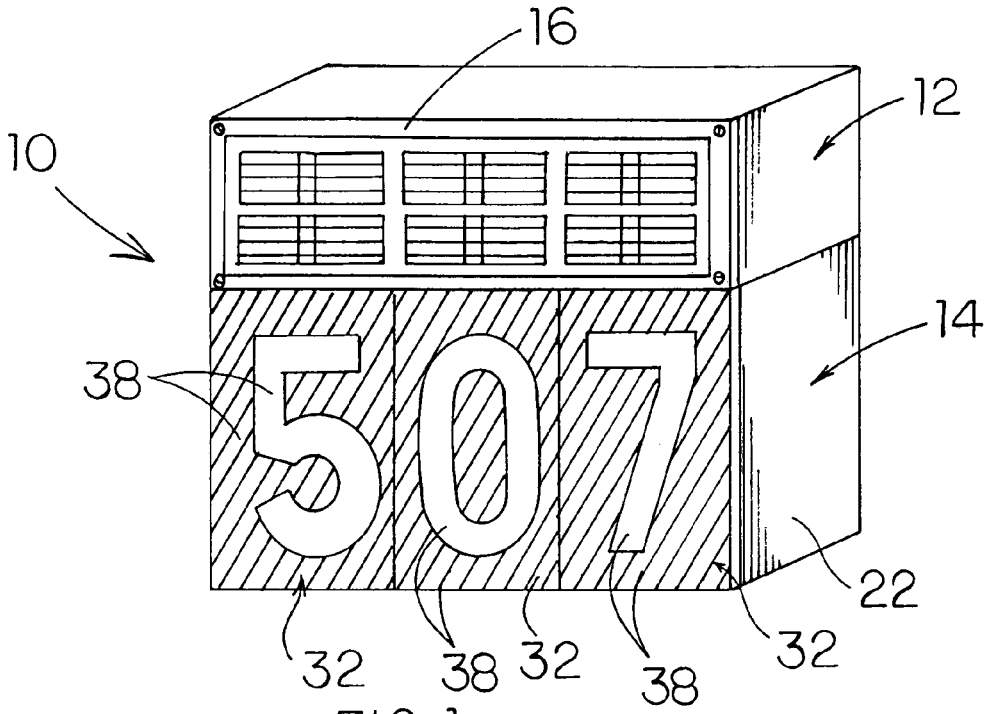
FIG. 1 is a perspective view of a solar powered illuminated device according to an embodiment of the present invention.

As shown in FIG. 1, a solar powered illuminated device 10 according to the present invention comprises a power module 12 and an illuminated module 14. In one embodiment, power module 12 comprises one or more solar cell arrays 16 electrically connected to a battery array. In other embodiments, battery array 18 comprises at least one rechargeable battery 20 which is charged with electrical power generated by and provided from the solar cell array 16. Solar cell array 16 comprises an array of conventional solar cells configured for absorbing energy from solar rays and converting such energy into electrical energy. Solar cells, arrays, and related components and their respective configurations being generally known in the art, no further description thereof is provided herein.

Figure 2:
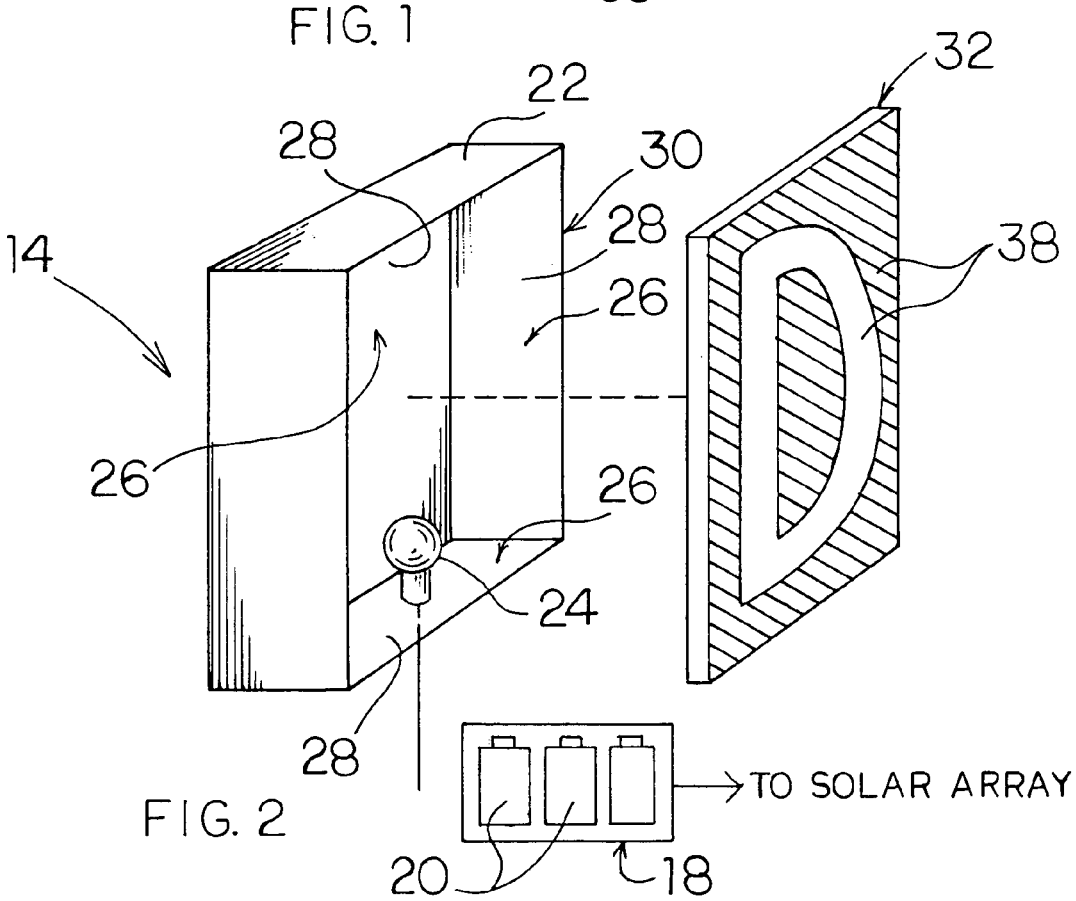
FIG. 2 is a plan view of an embodiment of a housing for an illuminated module.

As shown in FIG. 2, in one embodiment, the illuminated module 14 comprises one or more housings 22 having a light source 24 mounted therein which is electrically connected to the battery array 18. The inner surfaces 26 of each housing 22 have reflective material 28 either mounted thereon, affixed thereto, or positioned adjacent thereto, except for inner surfaces on one or more non-reflective sides 30 of the housing which are desired to be translucent or transparent for purposes which will be described herein. On such non-reflective sides 30, in one embodiment a display plate 32 is provided to substantially cover each such side. In other embodiments which will be further described herein, a translucent side 34 is provided to cover the non-reflective sides 30 of two or more adjacent housings 22 and a display plate 32 is mounted to an exterior obverse face 36 of the translucent side 34 and positioned corresponding to one of the housings 22. Display plates 32 may be mounted by any suitable means, such as a clear, pressure sensitive adhesive coating or strips applied to the back side of the display plate.

In one embodiment, the display plate 32 is manufactured with opaque and/or translucent and/or transparent materials 38. The display plate 32 may be configured to display one or more alphanumerical characters, designs, or symbols. In one embodiment, display plates 32 on one or more adjacent housings 22 collectively display a set of residential address names and/or numbers. In other embodiments, display plates 32 are configured to display a design, such as for a business trademark or service mark, or a themed design such as for a child's room, a den, playroom, or for an illuminated "bumper sticker" display mounted at the rear of a car such as in the rear window or on the rear face or bumper of the car. In yet other embodiments, display plates 32 are configured to display one or more useful symbols, such as a fireman or fireman's helmet to designate one or more rooms in a residence to be checked in case of a fire at such residence. The types of display plates 32 and the various cosmetic, decorative or useful purposes therefor will be obvious in light of this disclosure and are intended to be within the scope hereof.

Figure 15:
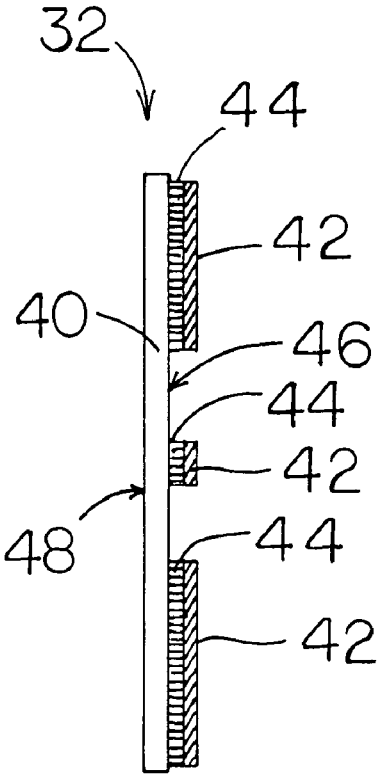
FIG. 15 is a side view of one embodiment of a display plate.
Figure 16:
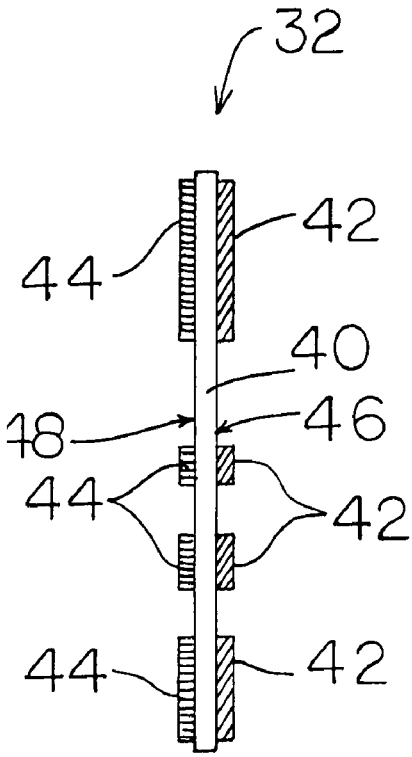
FIG. 16 is a side view of an alternative embodiment of a display plate.
Figure 17:
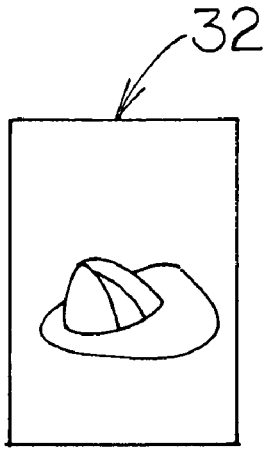
FIG. 17 is a front view of an embodiment of a display plate displaying a symbol.
Figure 18:
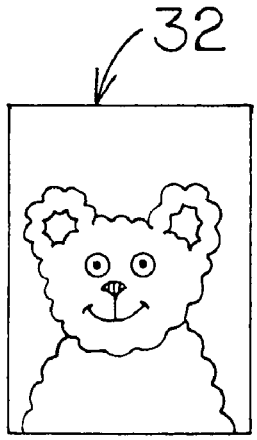
FIG. 18 is a front view of an embodiment of a display plate displaying a design.

In one embodiment shown in FIGS. 15 and 16, a display plate 32 comprises a translucent or transparent sheet 40 having one or more opaque material portions 42 affixed to one side 46 of the sheet to define the borders and/or background of the display. In other embodiments, a reflective film 44 is also affixed to the sheet 40 either at locations sandwiched between the sheet and any opaque material portions 42 or on an opposite side 48 of the sheet from the opaque material portions 42 at locations generally oppositely corresponding to any opaque material portions.

In one embodiment, the light sources 24 comprise light emitting diodes, or LED's. In other embodiments, at least one light source 24 is provided in a housing 22 that emits a on-white, colored light, such as red, yellow, green, blue, or purple, or any shade thereof and inbetween. In yet other embodiments, at least one light source 24 is provided in a housing 22 that emits a generally white or clear colored light.

While several equivalent structures for the illuminated module 14 will be obvious in light of this disclosure, which structures are intended to be within the scope of the attached claims, at least two possible structures are set forth herein as shown in FIGS. 3–12.

Figure 3:
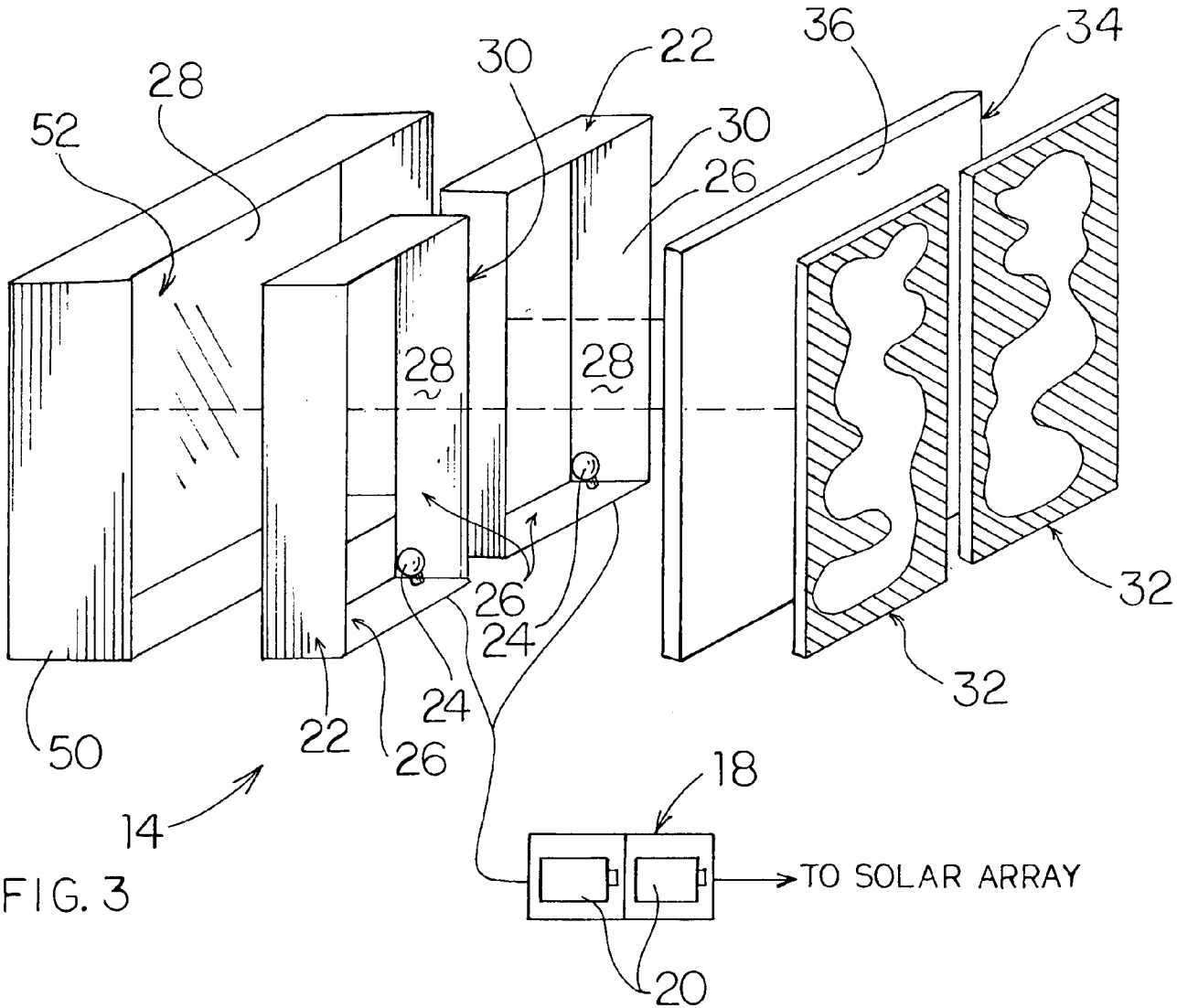
FIG. 3 illustrates an exploded view of one embodiment of an illuminated module comprising a receptacle, housings, a translucent side and display plates.
Figure 4:
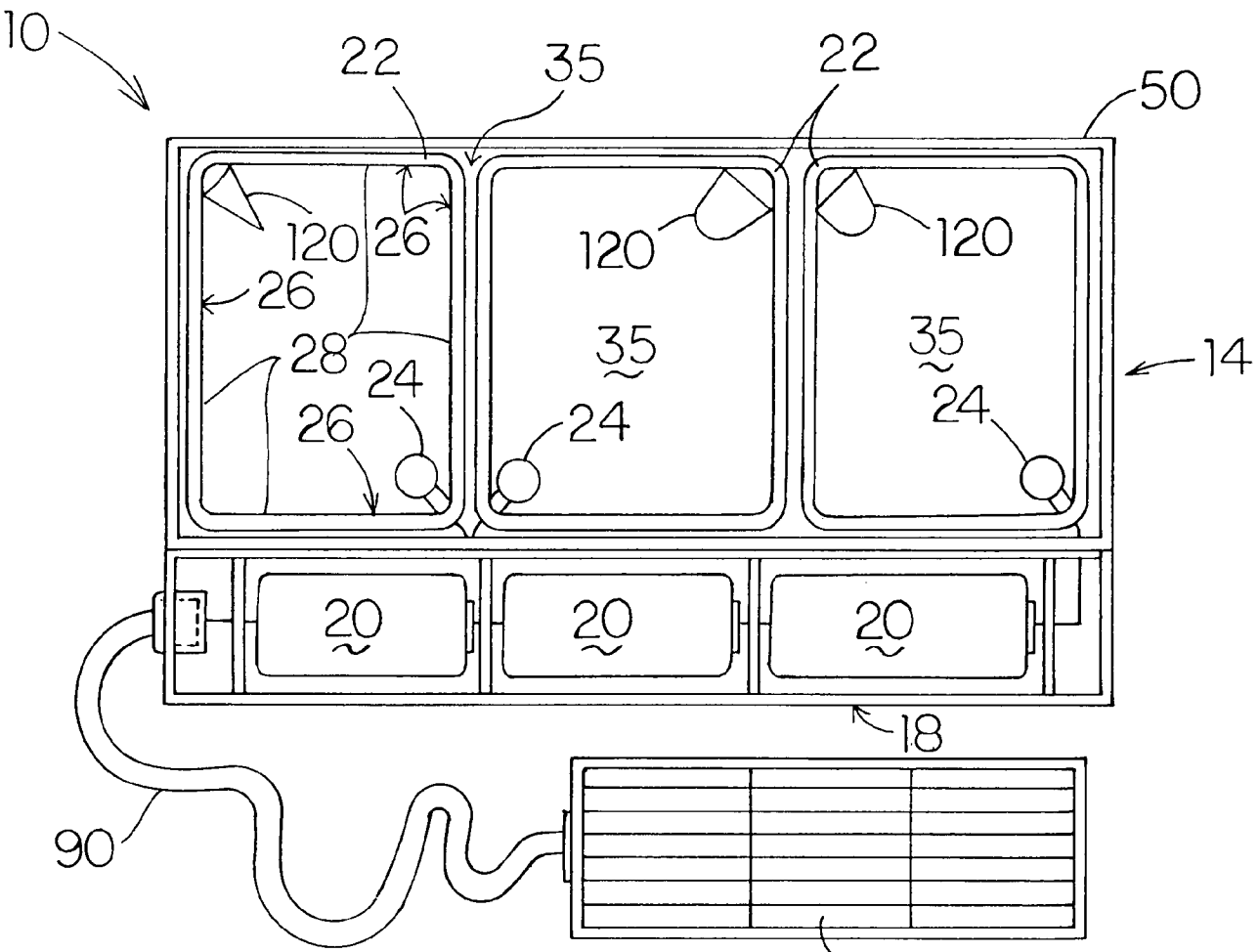
FIG. 4 is a front view of the illuminated module of FIG. 3 further comprising the battery array mounted within the illuminated module and the reflective side removed to reveal the interior of the receptacle.
Figure 5:
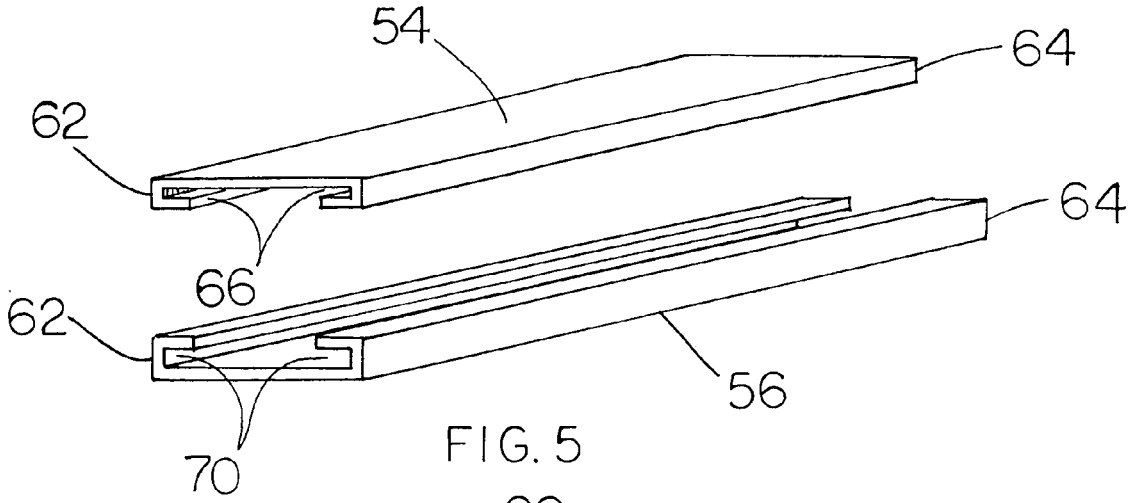
FIG. 5 illustrates a perspective view of a top support and a base support according to an embodiment of the present invention.
Figure 6:
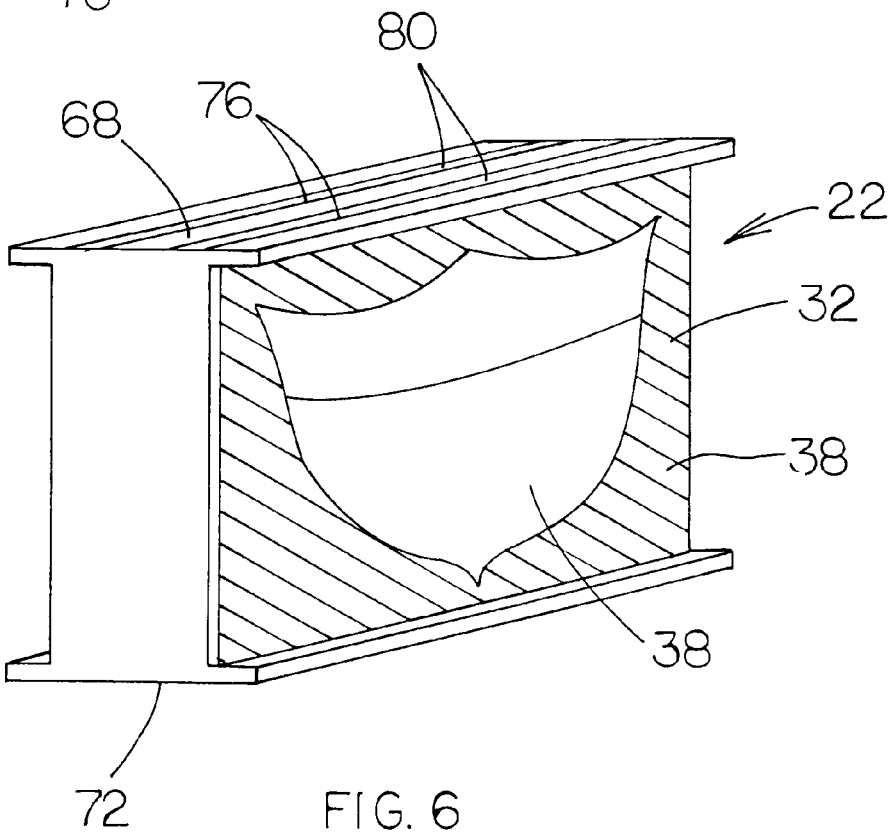
FIG. 6 shows a perspective view of an embodiment of a housing to be supported between the top and base supports of FIG. 5 at docking locations indicated by broken line illustrations of electrical guide contacts.
Figure 7:
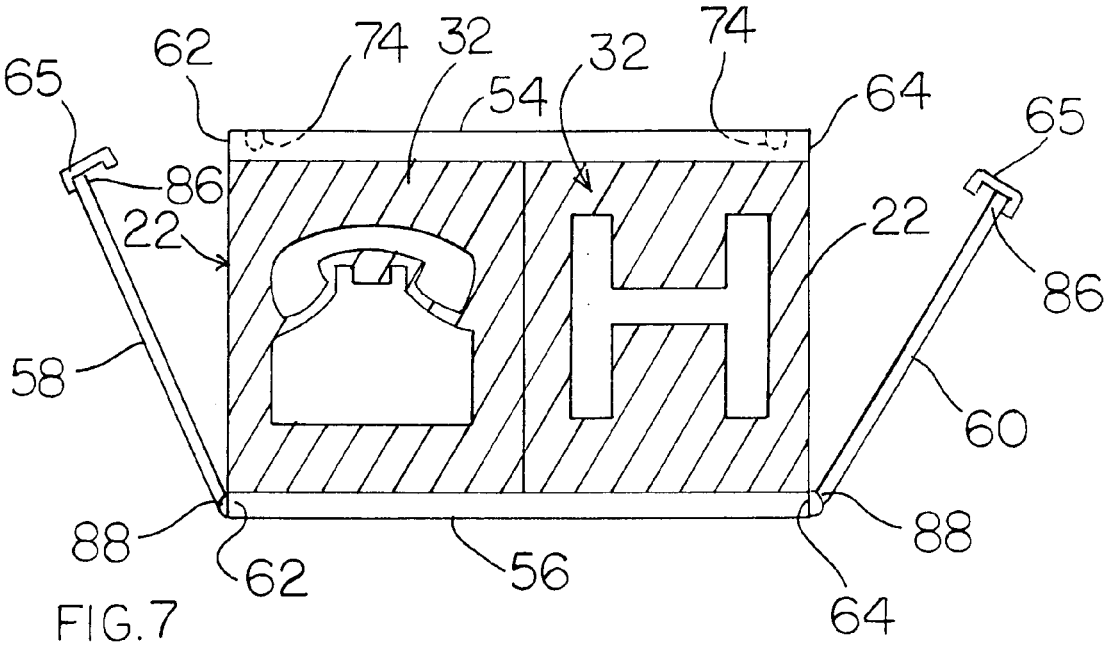
FIG. 7 shows a front view of an embodiment of an illuminated module showing first and second end plates for connecting the top and base supports.
Figure 8:
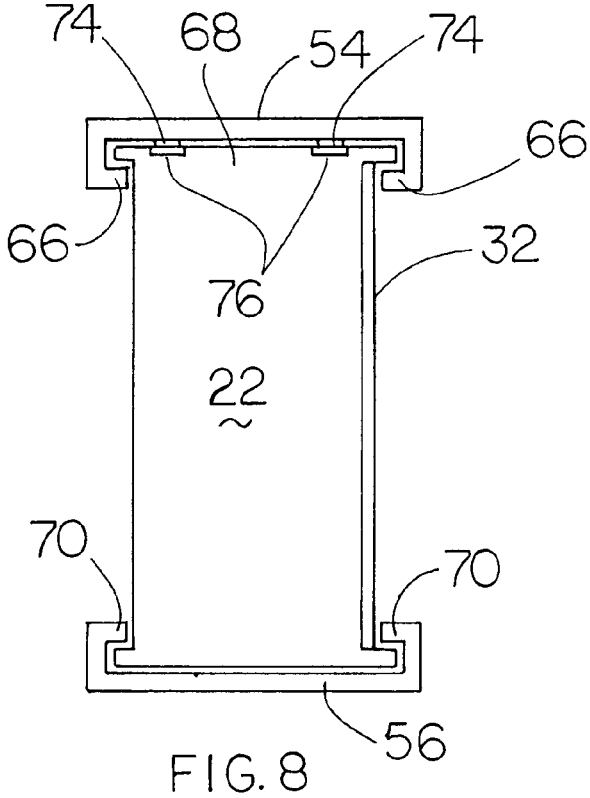
FIG. 8 shows a side view of the illuminated module of FIG. 7 with the end plate removed.

In one embodiment shown in FIGS. 3 and 4, the illuminated module 14 comprises a receptacle 50 configured to retain one or several housings 22, typically up to about 5 housings, although additional housings can be added by using larger receptacles. Each housing 22 is positioned in the receptacle so that at least one of the non-reflective sides 30 on each is facing outwardly in generally the same direction. The receptacle 50 comprises a translucent side 34 against which the non-reflective sides 30 are positioned so that translucent side 34 substantially covers each co-directional non-reflective side 30. Display plates 32 are mounted to the exterior obverse face 36 of the translucent side 34, one such display plate corresponding to one housing 22 in the receptacle 50. The receptacle 50 in one embodiment further comprises a reflective side 52 that encloses the receptacle. The reflective side 52 comprises an interior face substantially covered with a reflective material. The reflective side 52 may be provided for preventing light from undesirably escaping the housings 22. In other embodiments, reflective side 52 is replaced with a second translucent side (not shown) to accommodate additional non-reflective sides 30 that are not positioned adjacent the translucent side 34 during use of the device 10, to enable outward illumination of the housings in more than one direction.

In another embodiment of an illuminated module 14 shown in FIGS. 5–12, the illuminated module 14 comprises one or more housings 22 supported by a top support 54 and a base support 56. The housings 22 may further be supported by first and second end plates 58, 60 connecting the top and base supports at first and second ends 62, 64 thereof.

The top support 54 comprises a plurality of upper guides 66 for receiving an upper end 68 of each housing 22. Upper ends 68 are configured to engage upper guides 66 in any way that will be obvious, such as by tongue and groove engagement. Similarly, the base support 56 comprises a plurality of lower guides 70 for receiving a lower end 72 of each housing 22, generally using the same guide configuration as the engagement of upper guides 66 with the upper ends 68.

The top support 54 further comprises a plurality of spaced-apart electrical guide contacts 74 electrically connected to the battery array. The contacts 74 are located along the top support 54 to define docking locations for each housing 22 between the top and base supports 54, 56. Contacts 74 contact corresponding receiver contacts 76 on the upper end 68 of each housing 22 when positioned in a docking location. Receiver contacts 76 are electrically connected to the light source 24 in the housing 22. In one embodiment, guide contacts 74 at each docking location comprise a pair of flat, spring-type contact tabs 78 that transverse a pair of parallel flat ribbons 80, such as on a printed circuit board, which comprise the receiver contacts 76. In other embodiments, the tabs 78 and ribbons 80 are manufactured of copper or a copper alloy suitable for direct current electrical connections.

Figure 9:
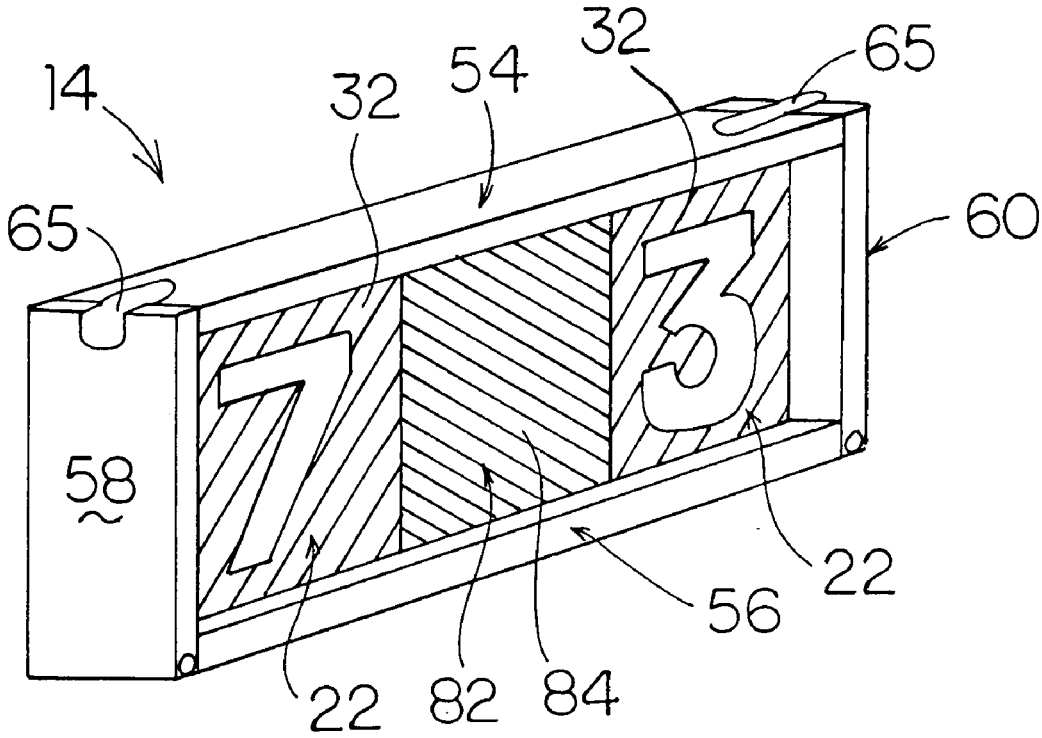
FIG. 9 shows a perspective view of an embodiment of an illuminated module having top and base supports and the first and second end plates connected thereto with housings supported therein, including a filler housing.
Figure 10:
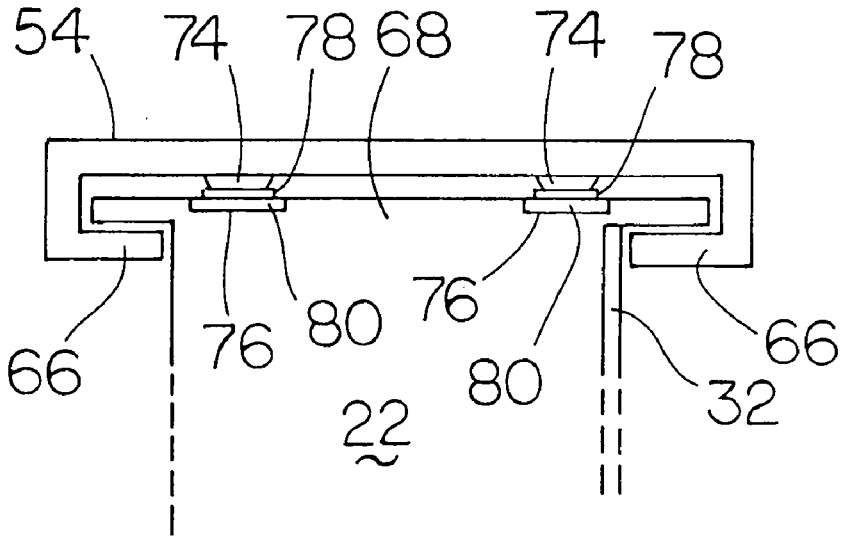
FIG. 10 is a partial view of an upper end of a housing received within the upper guides of the top support, showing the engagement between the electrical guide contacts and the receiver contacts.

In such embodiments, it may be desirable to include a spacer or filler housing 82 as shown in FIG. 9, which is left unilluminated in the context of the collective display produced by other housings 22 in the illuminated module 14. Filler housings 82 are externally configured similarly to housing 22 but have only opaque exterior faces 84 and have no receiver contacts 76 nor light source 24 mounted therein.

The structural stability, integrity, and/or unity of an illuminated module 14 according to FIGS. 5–12 may be enhanced using the first and second end plates 58, 60. The end plates each connect the top and base supports 54, 56 at the first and second ends 62, 64 of each support. Top ends 86 and bottom ends 88 of the end plates 58, 60 are secured to corresponding ends 62, 64 using any known means of securement 65. In one embodiment, hinged brackets, hinged clamps, rigid brackets, rigid bracket clamps, or any combination of these as desired are used to secure the end display plates 58, 60 between the top and base supports 54, 56 at the first and second ends 62, 64.

Reflective surfaces and reflective films are utilized within the illuminated module 14 and housings 22 to enhance the illumination desired to be emitted from the device 10. A reflective interior substantially prevents emitted light being lost by absorption in the housing 22 and illuminated module 14. Absorbance, generally, is, percentage wise, 100% minus percentage of reflectance. The more reflective the interior surfaces are which are not intended to create the illuminating characteristics of the device 10, the less light is lost and the more illuminative the device is. In one embodiment, reflective surfaces, films and material used in the device comprise any viable metalized film material or metal foil material. In other embodiments, the metalized film or metal foil material comprises one or more of aluminum, tin, silver and chrome, or any combination thereof.

Power module 12 generally comprises solar cell array 16 which is electrically connected to the battery array 18. In one embodiment, the power module 12 is positioned proximate to the illuminated module 14, as shown in FIG. 1. In other embodiments, power module 12 is remote from the illuminated module 14, as shown in FIG. 4, to allow for optimal positioning of the solar cell array 16 to receive solar energy and convert it to electrical power. When remotely positioned, the power module 12 has a suitable electrical wiring cord 90 connecting it to the illuminated module 14. One such suitable electrical wiring cord is a multi-strand electrical interconnect 91 having direct current capabilities.

The underlying circuit logic of the power module 12 requires a photo switching device 92 interconnected between the solar cell array 16 and the battery array 18. During generally daylight hours, solar cell array 16 generates and provides electrical current which is sent to the battery array 18 to charge the rechargeable batteries 20. This is generally a power charging mode. During generally non-daylight hours, photo switching device 92 functionally recognizes the absence of current provided form the solar cell array 16 and switches power module 12 from the power charging mode into a power source mode in which electrical current is discharged from the battery array 18 to the light sources 24 in the illuminated module 14. The photo switching device 92 comprises one or more electrically or optically activated switches 94 that allow the illuminated module 14 to be illuminated during generally non-daylight hours (such as at night) and automatically turned off during generally daylight hours. Furthermore, switches 94 activate the solar cell array 16 to permit it to charge the batteries 20 during such generally daylight hours.

In one embodiment, a uni-directional current component 96 is additionally interconnected between the solar cell array 16 and the battery array 18 to prevent the rechargeable batteries 20 in the battery array from draining power back at the solar cell array 16 during either or both the power charging mode and the power source mode, depending upon the electrical circuit logic used. In other embodiments, the component 96 comprises a blocking diode 98, which is generally known in the art for use with photo switching devices having optically or electrically activated switches.

Figure 13:
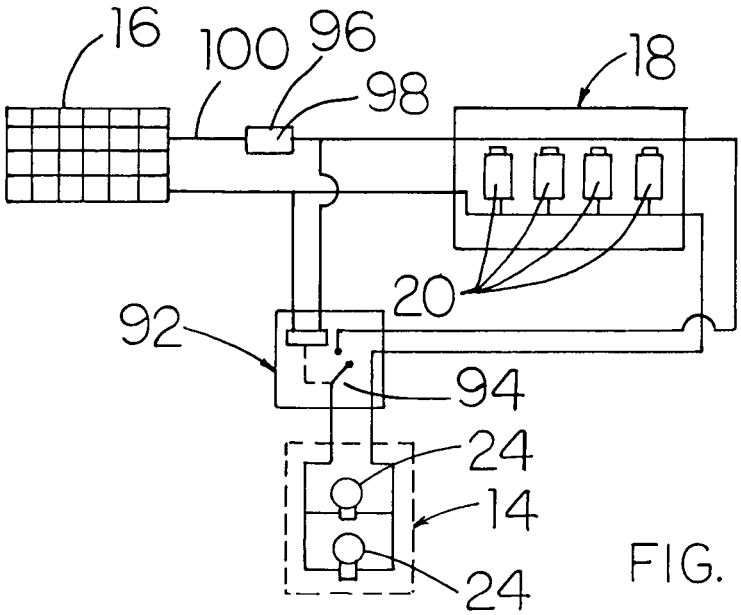
FIG. 13 is a circuit diagram for one embodiment of circuit logic underlying the electrical connections of the illuminated display device of the present invention.
Figure 14:
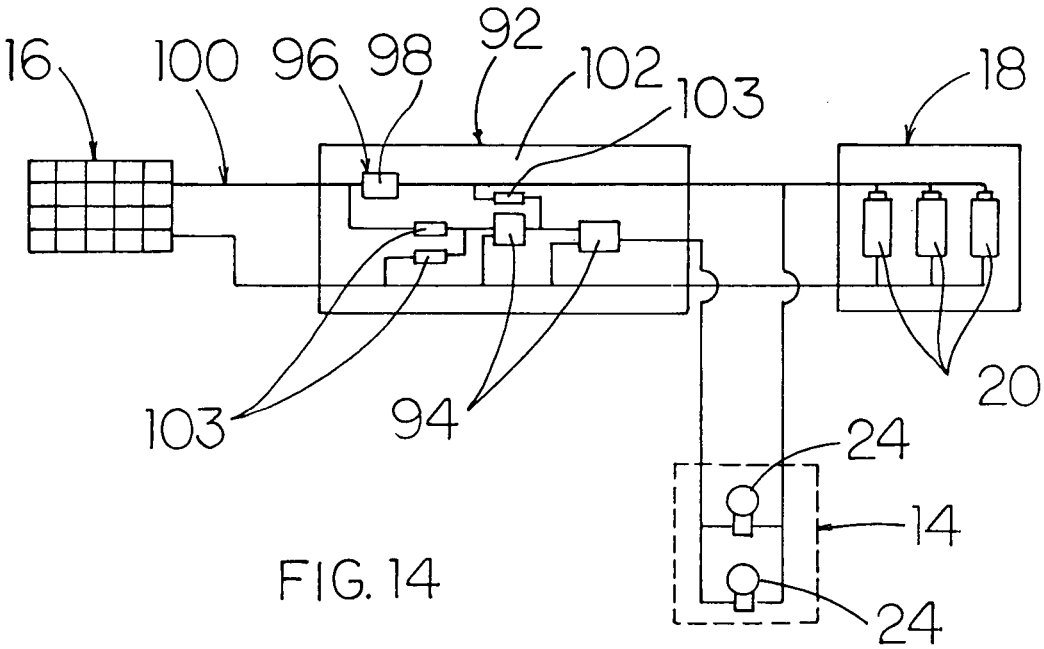
FIG. 14 is a circuit diagram of another embodiment of the underlying circuit logic for the electrical connections of an illuminated display device according to the present invention.

FIGS. 13 and 14 show circuit diagrams for different embodiments of possible circuit logic for a power module 14 including a battery array 18 having a plurality of rechargeable batteries 20, in accordance with required function of the present invention. It being well known in the art to create circuit logic that achieves the functional switching described herein, the embodiments shown are for purposes of illustration only and are not intended to limit the scope of the invention or the claims to any one particular circuit logic. The illustrated embodiments as well as equivalents thereto and any other circuit logic that performs the functions generally described herein are within the scope of the invention and the claims.

In FIG. 13, solar cell array 16 is contained on a closed circuit with the battery array 18. A blocking diode 98 is contained on the lead line 100 from the solar cell array 16 to prevent the batteries 20 from draining current. Solar cell array 16 is further connected to photo switching device 92 for purposes of activating switch 94. Switch 94 opens and closes a circuit from the battery array 18 to the light sources 24 and the illuminated module 14. During the power charging mode, switch 94 is open to prevent illuminating the light sources 24. During the power source mode, switch 94 is closed to complete the circuit with the light sources 24. Blocking diode 98 crosses the current discharging from the battery array to the illuminated module 14.

FIG. 14 shows an alternative embodiment utilizing a circuit board 102 connecting solar cell array 16 to both the battery array 18 and to the light sources 24 and the illuminated module 14. Circuit board 102 comprises the photo switching device 92 and contains a blocking diode 98 connected to the lead line 100 on the board 102. A plurality of switches 94 are contained on the board which are configured to switch the power module 12 to and from power charging mode and power source mode according to the daylight conditions. In one embodiment, the circuit board 102 comprises an off-the-shelf photo switching device commercially available at least to those skilled in the art. In other embodiments, circuit board 102 comprises a logic board from a commercially available lawn and garden lighting system. In yet other embodiments, the circuit board 102 further comprises one or more resistors 103 as needed to regulate the current flowing across the circuit board.

Figure 11:
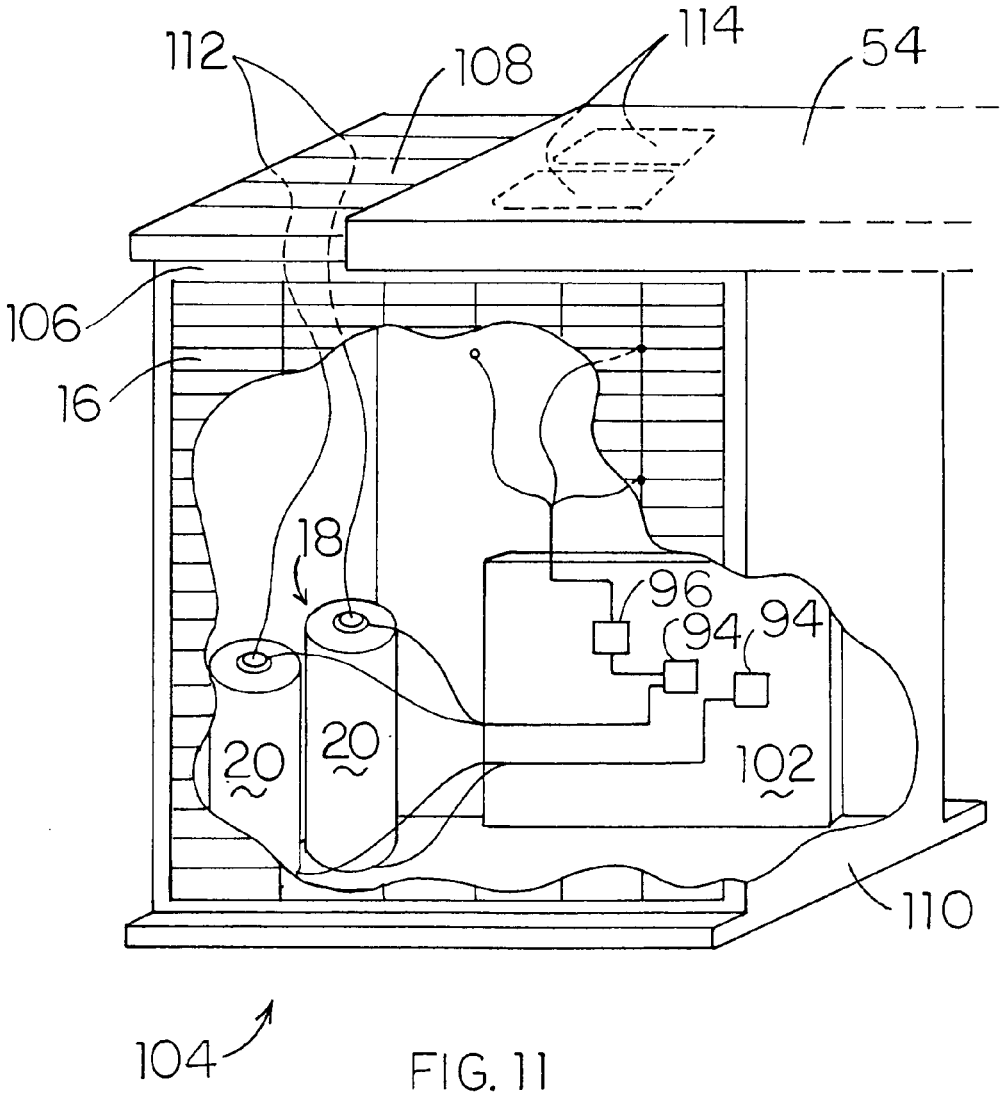
FIG. 11 is a perspective view of an embodiment of a power housing with a portion broken out for viewing one embodiment of the interior for such power housing.
Figure 12:
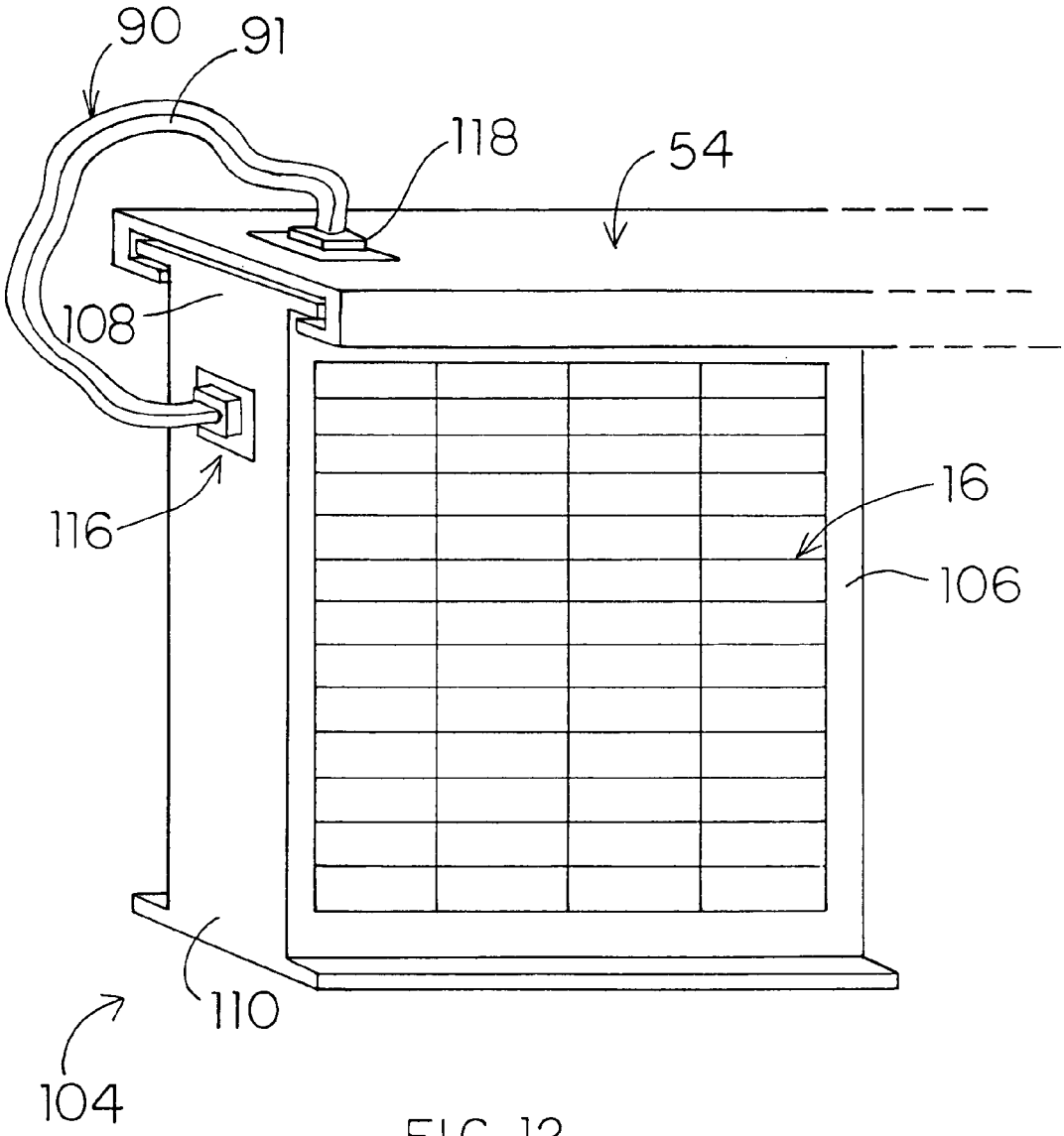
FIG. 12 illustrates a perspective view of another embodiment of a power housing having terminal connectors for the electrical connection of the power housing to the electrical connections in the top support.

In the embodiments of the illuminated module 14 shown in FIGS. 5–12 having top and base supports 54, 56 and first and second end plates 58, 60, the power module 12 may further be provided as mounted within these supports and end display plates as a power housing 104 having similar configuration to the housings 22 that are also contained within the supports and end plates. As shown in FIGS. 11 and 12, power housing 104 in one embodiment comprises the solar cell array 16 mounted on an outer face 106 of the power housing 104, with the battery array 18 and photo switching device 92 contained within the power housing 104. The power housing further comprises an upper end 108 and a lower end 110 similarly configured like the upper end 68 and lower end 72 of housings 22 for engagement with the upper guides 66 and the lower guides 70. The upper end 108 of the power housing 104 in yet other embodiments is electrically connected to the electrical guide contacts 74 and the top support 54. In one embodiment, this electrical connection is achieved by connector contacts 112 on the upper end 108 of the power housing 104 engaging corresponding connector contacts 114 on the top support 54, the corresponding connector contacts being electrically connected to the electrical guide contacts, the connector contacts 112 being electrically connected to the battery array 18. In other embodiments, the electrical connection is achieved by a connector terminal 116 on the power housing 104 electrically connected to a corresponding connector terminal 118 on the top support 54, the corresponding connector terminal being electrically connected to the electrical guide contacts 74, the connector terminal 116 being electrically connected to the battery array 18.

In order to further enhance the dispersion of light emitted from light sources 24 within the housing 22 with the reflective inner surfaces 26 and/or reflective side 52, in one embodiment, housings 22 further comprise a target 120 mounted generally directionally opposite the light source 24 and the housing 22, the target being configured to reflectively disperse light emitted from the light source. In one embodiment, the target 120 comprises a generally conical shape having a point and generally at the light source 24. In other embodiments, target 120 comprises a generally hyperbolic or parabolic shape having a closed end aimed generally at the light source 24.

The invention being thus described, it will be evident that the same may be varied in many ways. Such variations are not to be regarded as a departure from spirit and scope of the invention and all such modifications are intended to be included within the scope of the following claims:

What is claimed is:

1. A solar powered illuminated device comprising: a power module electrically connected to at least one illuminated module, said power module comprising at least one solar cell array electrically connected to a battery array comprising at least one rechargeable battery, said power module further comprising a photo-switching device interconnected between said solar cell array and said battery array, said illuminated module comprising at least one housing having a display plate forming at least one non-reflective side thereof and reflective material on inner surfaces of substantially all other sides thereof, a light source mounted within each said housing and electrically connected to said battery array, said light source illuminating said inner surfaces of said display plate and said housing sides by reflective light, said display plate being manufactured of at least one of opaque, translucent and transparent materials, said illuminated module comprising a receptacle configured to retain from about 1 to about 5 said housings, each said housing having a respective said non-reflective side facing outwardly generally in the same direction, said receptacle having a translucent side substantially covering each said non-reflective side, said display plate corresponding to each said housing being mounted proximate said housing on an exterior obverse face of said translucent side, said receptacle further comprising a reflective side configured to enclose said receptacle, said reflective side having an interior face substantially covered with a reflective material.

2. The device of claim 1 wherein said photo-switching device is configured to switch said battery array from a power charging mode occurring during generally daylight hours to a power source mode occurring during generally non-daylight hours, said power charging mode comprising electrical charging of said battery array with electrical current generated and provided to it by said solar cell array, said power source mode comprising providing electrical current from said battery array to said light source for emitting light in said housing.

3. The device of claim 2 further comprising a uni-directional current component interconnected between said solar cell array and said battery array, said component configured to prevent current from discharging from said battery array during said power charging mode.

4. The device of claim 3 wherein said uni-directional current component comprises a blocking diode configured to prevent current flowing from said battery array to said solar cell array or to said illuminated device during said power charging mode.

5. The device of claim 1 wherein said power module is remote from said illuminated module and connected to said illuminated module via an electrical wiring cord.

6. The device of claim 5 wherein said battery array is remote from said illuminated module and mounted either adjacent to or within said power module, said electrical wiring cord connecting said power module to said battery array.

7. The device of claim 6 wherein said electrical wiring comprises a suitable multi-strand electrical interconnect.

8. The device of claim 5 wherein said battery array is mounted remote from said illuminated and power modules.

9. The device of claim 1 wherein said photo-switching device comprises at least one optically or electrically activated switch configured to allow each said light source to be illuminated by current from said battery array and to turn off each said light source during generally daylight hours and activate said solar cell array for charging said at least one rechargeable battery.

10. The device of claim 9 wherein said photo-switching device comprises a single said switch, said switch connected to and activated by said solar cell array and configured to open and close a circuit between said battery array and said illuminated device, said circuit being open during generally daylight hours and closed during generally non-daylight hours, said solar cell array being on a closed circuit with said battery array, said closed circuit comprising a blocking diode on a lead line from said solar cell array.

11. The device of claim 9 wherein said photo-switching device comprises a circuit board containing a blocking diode connected to a lead line from said solar cell array on said circuit board and a plurality of switches configured to switch said power module from a power charging mode during generally daylight hours to a power source mode during generally non-daylight hours, said power charging mode comprising electrical charging of said battery array with electrical current generated and provided to it by said solar cell array, said power source mode comprising providing electrical current from said battery array to each said light source for emitting light in said housing.

12. The device of claim 1 wherein said illuminated device comprises at least two said housings adjacent one another, said display plate on each said housing facing outwardly from said housing generally in the same direction.

13. The device of claim 12 wherein said display plates are configured to collectively display at least one set of alphanumerical characters.

14. The device of claim 12 wherein said display plates are configured to collectively display at least one symbol.

15. The device of claim 12 wherein said display plates are configured to collectively display at least one design.

16. The device of claim 1 wherein each of said display plates is configured to display at least one of the group consisting of a set of alphanumerical characters, a symbol and a design.

17. The device of claim 1 wherein each said light source comprises a light emitting diode.

18. The device of claim 1 wherein at least one said light source emits a non-white, colored light.

19. The device of claim 1 wherein at least one said light source emits a generally white light.

20. The device of claim 1 wherein each said housing further comprises a target mounted directionally generally opposite said light source, said target being configured to reflectively disperse light emitted from said light source.

21. The device of claim 20 wherein said target comprises a generally conical shape having a point aimed generally at said light source.

22. The device of claim 20 wherein said target comprises a generally hyperbolic or parabolic shape having a closed end aimed generally at said light source.

23. The device of claim 1 wherein said opaque, translucent and transparent materials are configured to display at least one alphanumeric character.

24. The device of claim 1 wherein said translucent and transparent materials comprise at least one non-white color.

25. The device of claim 1 wherein said reflective surfaces and said reflective material comprise at least one material selected from the group consisting of metalized film and metal foil.

26. The device of claim 25 wherein each said at least one material selected comprises a metallic material chosen from the group consisting of: aluminum, tin, silver and chrome.

27. The device of claim 1 wherein each said display plate comprises a translucent or transparent sheet having opaque material portions affixed to one side of said sheet.

28. The device of claim 27 further comprising a reflective film affixed to said sheet either between said sheet and said opaque material portions or on an opposite side of said sheet from said opaque material portions and generally oppositely corresponding to said opaque material portions.

29. A solar powered illuminated device comprising: a power module electrically connected to at least one illuminated module, said power module comprising at least one solar cell array electrically connected to a battery array comprising at least one rechargeable battery, said power module further comprising a photo-switching device interconnected between said solar cell array and said battery array, said illuminated module comprising at least one housing having a display plate forming at least one non-reflective side thereof and reflective material on inner surfaces of substantially all other sides thereof, a light source mounted within each said housing and electrically connected to said battery array, said light source illuminating said inner surfaces of said display plate and said housing sides by surface reflective light, said display plate being manufactured of at least one of opaque, translucent and transparent materials, said illuminated module comprises a top support and a base support, said top support comprising a plurality of upper guides for receiving an upper end of each said housing and a plurality of spaced apart electrical guide contacts, each said guide contact electrically connected to said battery array, said upper end of each said housing having corresponding receiver contacts for engaging one said contact when positioned within said top support, each said receiver contact electrically connected to said light source in said housing, said base support comprising a plurality of lower guides for receiving a lower end of each said housing.

30. The device of claim 29 wherein said electrical guide contacts are located along an underside of said top support to define docking locations for each said housing.

31. The device of claim 30 wherein said electrical guide contacts at each said docking location comprise a pair of flat, spring-type contact tabs and wherein said receiver contacts on each said housing comprise a pair of parallel flat ribbons.

32. The device of claim 29 further comprising first and second end plates, said first end plate connecting said top support and said base support at first ends thereof, said second end plate connecting said top support and said base support at second ends thereof.

33. The device of claim 29 wherein said first and second end display plates each have a hinge and a clamp for connecting to said top support and said base supports at the first and second ends thereof.

34. The device of claim 29 wherein said power module comprises a power housing having similar configuration to said housings, said power housing comprising said solar cell array on an outer face thereof and containing said battery array and said photo-switching device therein, said power housing having an upper and a lower end configured for engagement with said upper guides and said lower guides, respectively, said power housing further being electrically connected to said electrical guide contacts.

35. The device of claim 34 wherein said upper end of said power housing comprises connector contacts engaging corresponding connector contacts on said top support, said corresponding connector contacts being electrically connected to said electrical guide contacts, said connector contacts being electrically connected to said battery array.

36. The device of claim 34 wherein said power housing further comprises a connector terminal electrically connected to a corresponding connector terminal on said top support, said corresponding connector terminal being electrically connected to said electrical guide contacts, said connector terminal being electrically connected to said battery array.

37. A solar powered illuminated device comprising: a power module electrically connected to at least one illuminated module, said power module comprising at least one solar cell array electrically connected to a battery array comprising at least one rechargeable battery, said power module further comprising a photo-switching device and a blocking diode interconnected between said solar cell array and said battery array, said illuminated module comprising a receptacle configured to receive at least two housings, said receptacle having a translucent side substantially covering one non-reflective side of said housing and a reflective side substantially covering another side of said housing, said illuminated module further comprising a display plate corresponding to each said housing mounted to an exterior obverse face of said translucent side, said display plate being manufactured of at least one of opaque, translucent and transparent materials, and a light source mounted within each said housing and electrically connected to said battery array.

38. The device of claim 37 wherein said photo-switching device is configured to switch said battery array from a power charging mode occurring during generally daylight hours to a power source mode occurring during generally non-daylight hours, said power charging mode comprising electrical charging of said battery array with electrical current generated and provided to it by said solar cell array, said power source mode comprising providing electrical current from said battery array to said light source for emitting light in said housing, and said power module comprising a uni-directional current component interconnected between said solar cell array and said battery array, said component being figured to prevent current from discharging from said battery array during said power charging mode.

39. The device of claim 37 wherein said power module is remote from said illuminated module and connected to said illuminated module via an electrical wiring cord.

40. The device of claim 39 wherein said battery array is remote from said illuminated module and mounted either adjacent to or within said power module, said electrical wiring cord connecting said power modules to said battery array.

41. The device of claim 39 wherein said battery array is mounted remote from said power and illuminated modules.

42. The device of claim 37 wherein said photo-switching device comprises at least one optically or electrically activated switch configured to allow each said light source to be illuminated by current from said battery array and to turn off each said light source during generally daylight hours and activate said solar cell array for charging said at least one rechargeable battery.

43. The device of claim 37 wherein said display plates are configured to collectively display at least one of the group consisting of a set of alphanumerical characters, a symbol and a design.

44. The device of claim 37 wherein each said light source comprises a light emitting diode.

45. The device of claim 37 wherein at least one said light source emits a non-white, colored light.

46. The device of claim 37 wherein at least one said light source emits a generally white light.

47. The device of claim 37 wherein each said housing further comprises a target mounted directionally opposite said light source, said target being configured to reflectively disburse light emitted from said light source.

48. The device of claim 47 wherein said target comprises a generally conical shape having a point aimed generally at said light source.

49. The device of claim 47 wherein said target comprises a generally hyperbolic or parabolic shape having a closed end aimed generally at said light source.

50. The device of claim 37 wherein said opaque, translucent and transparent materials are configured to display at least one alphanumeric character.

51. The device of claim 37 wherein said translucent and transparent materials comprise at least one non-white color.

52. The device of claim 37 wherein each said display plate comprises a translucent or transparent sheet having opaque material portions affixed to one side of said sheet.

53. The device of claim 37 further comprising a reflective film affixed to said sheet either between said sheet and aid opaque material portions or on an opposite side of said sheet from said opaque material portions and generally oppositely corresponding to said opaque material portions.

54. A solar powered illuminated device comprising: a power module electrically connected to at least one illuminated module, said power module comprising at least one solar cell array electrically connected to a battery array comprising at least one rechargeable battery, said power module further comprising a photo-switching device and a blocking diode interconnected between said solar cell array and said battery array, said illuminated module comprising at least two housings each having a display plate covering at least one non-reflective side thereof and reflective material substantially covering inner surfaces of substantially all other sides thereof, a light source mounted within each said housing and electrically connected to said battery array, said light source illuminating said inner surfaces of said display plate and said housing sides with reflective light said display plate being manufactured of at least one of opaque, translucent and transparent materials, said illuminated module further comprising a top support and a base support, said top support comprising a plurality of upper guides for receiving an upper end of each said housing and a plurality of spaced apart electrical guide contacts, each said guide contact electrically connected to said battery array, said upper end of each said housing having corresponding receiver contacts for engaging one said contact when positioned within said top support, each said receiver contact electrically connected to said light source in said housing, said base support comprising a plurality of lower guides for receiving a lower end of each said housing, and further comprising first and second end plates, said first end plate connecting said top support and said base support at first ends thereof, said second end plate connecting said top support and said base support at second ends thereof.

55. The device of claim 54 wherein said photo-switching device is configured to switch said battery array from a power charging mode occurring during generally daylight hours to a power source mode occurring during generally non-daylight hours, said power charging mode comprising electrical charging of said battery array with electrical current generated and provided to it by said solar cell array, said power source mode comprising providing electrical current from said battery array to said light source for emitting light in said housing, and said power module comprising a uni-directional current component interconnected between said solar cell array and said battery array, said component being figured to prevent current from discharging from said battery array during said power charging mode.

56. The device of claim 54 wherein said power module is remote from said illuminated module and connected to said illuminated module via an electrical wiring cord.

57. The device of claim 54 wherein said power module comprises a power housing having similar configuration to said housings, said power housing comprising said solar cell array on an outer face thereof and containing said battery array and said photo-switching device therein, said power housing having an upper and a lower end configured for engagement with said upper guides and said lower guides, respectively, said power housing further being electrically connected to said electrical guide contacts.

58. The device of claim 57 wherein said upper end of said power housing comprises connector contacts engaging corresponding connector contacts on said top support, said corresponding connector contacts being electrically connected to said electrical guide contacts, said connector contacts being electrically connected to said battery array.

59. The device of claim 57 wherein said power housing further comprises a connector terminal electrically connected to a corresponding connector terminal on said top support, said corresponding connector terminal being electrically connected to said electrical guide contacts, said connector terminal being electrically connected to said battery array.

60. The device of claim 54 wherein said photo-switching device comprises at least one optically or electrically activated switch configured to allow each said light source to be illuminated by current from said battery array and to turn off each said light source during generally daylight hours and activate said solar cell array for charging said at least one rechargeable battery.

61. The device of claim 54 wherein said display plates are configured to collectively display at least one of the group consisting of a set of alphanumerical characters, a symbol and a design.

62. The device of claim 54 wherein each said light source comprises a light emitting diode.

63. The device of claim 54 wherein at least one said light source emits a non-white, colored light.

64. The device of claim 54 wherein at least one said light source emits a generally white light.

65. The device of claim 54 wherein each said housing further comprises a target mounted directionally opposite said light source, said target being configured to reflectively disburse light emitted from said light source.

66. The device of claim 65 wherein said target comprises a generally conical shape having a point aimed generally at said light source.

67. The device of claim 65 wherein said target comprises a generally hyperbolic or parabolic shape having a closed end aimed generally at said light source.

68. The device of claim 54 wherein said opaque, translucent and transparent materials are configured to display at least one alphanumeric character.

69. The device of claim 54 wherein said translucent and transparent materials comprise at least one non-white color.

70. The device of claim 54 wherein each said display plate comprises a translucent or transparent sheet having opaque material portions affixed to one side of said sheet.

71. The device of claim 54 further comprising a reflective film affixed to said sheet either between said sheet and aid opaque material portions or on an opposite side of said sheet from said opaque material portions and generally oppositely corresponding to said opaque material portions.

* * * * *